US005182988A

United States Patent [19]

Styfhoorn

[11] Patent Number: 5,182,988

[45] Date of Patent: Feb. 2, 1993

[54] OIL FILTER CRUSHER

[75] Inventor: John Styfhoorn, Dunlap, Ill.

[73] Assignee: Caterpillar Inc., Peoria, Ill.

[21] Appl. No.: 860,256

[22] Filed: Mar. 31, 1992

Related U.S. Application Data

[63] Continuation of Ser. No. 658,495, Feb. 21, 1991, abandoned.

[51] Int. Cl.[5] ..... B30B 9/02; B30B 9/32

[52] U.S. Cl. ..... 100/98 R; 100/125; 100/131; 100/902; 100/246; 100/245

[58] Field of Search ..... 100/902, 246, 247, 245, 100/240, 98 R, 125, 131, 53

[56] References Cited

U.S. PATENT DOCUMENTS

| | | | |
|---|---|---|---|
| 2,544,222 | 3/1951 | D'Amico | 100/247 |
| 2,800,159 | 7/1957 | Walsh | 100/246 |
| 3,882,771 | 5/1975 | Frohbieter | 100/246 |
| 4,088,072 | 5/1978 | Wittmeier | 100/902 |
| 4,249,400 | 2/1981 | Arendt | 100/215 |
| 4,334,469 | 6/1982 | Tanner | 100/902 |
| 4,809,600 | 3/1989 | Yamamoto | 100/902 |
| 4,897,222 | 1/1990 | Müntzel | 100/215 |

FOREIGN PATENT DOCUMENTS

| | | | |
|---|---|---|---|
| 0124185 | 11/1984 | European Pat. Off. | 100/902 |
| 3317680 | 6/1984 | Fed. Rep. of Germany | 100/902 |
| 137600 | 6/1988 | Japan | 100/214 |

*Primary Examiner*—Harvey C. Hornsby
*Assistant Examiner*—Tony G. Soohoo
*Attorney, Agent, or Firm*—Claude F. White

[57] ABSTRACT

Apparatus for crushing and severely reducing the overall dimensions of used fluid filters before they are discarded includes a housing assembly having a base portion, a head portion, and side wall portions joining the base portion to the head portion. First and second cylindrical sleeves positioned within the housing substantially completely enclose each filter during the crushing operation. During the crushing operation, each filter rests on the base portion and a hydraulically operated ram assembly forces a piston against the filter and crushes the filter between the base portion and the piston. The side walls portions and the first cylindrical sleeve restrict lateral movement of the piston and filter during the crushing operation. A considerable amount of used fluid is re-claimed from the filters as a result of the crushing operation.

8 Claims, 6 Drawing Sheets

OIL FILTER CRUSHER

This is a continuation of Ser. No. 07,658,495, filed Feb. 21, 1991, now abandoned.

TECHNICAL FIELD

This invention relates generally to apparatus for crushing fluid-type filters and more particularly to such apparatus which performs the crushing operation in a quick and efficient manner. The overall size of the filters is drastically reduced and a considerable amount of used fluid is re-claimed from the crushed filters.

BACKGROUND ART

Disposal of wastes and discarded materials is becoming more difficult as landfills begin to fill up, and as local, state and federal governments institute strict rules and regulations as to what can be disposed of in landfills. Such regulations are especially stringent concerning hazardous and quasi-hazardous wastes. Many regulations also require waste to be reduced in size before it is disposed of in landfills.

One such landfill regulation concerns the disposal of used fluid filters, such as used oil filters removed from construction and earthmoving vehicles. Thousands of such filters are removed from vehicles everyday, and until recently have been discarded into disposal dumpsters and ultimately dumped in landfills. New and proposed regulations require that such filters be reduced in size by crushing in some manner before being disposed of.

Several different types of crushing apparatus have been proposed, and a few prototypes have been built and utilized with varying degrees of success. However, most of the previously utilized crushing apparatus failed to provide all of the desired features of speed, efficiency, and safety.

The present invention is directed to overcoming one or more of the problems as set forth above.

DISCLOSURE OF THE INVENTION

In one aspect of the present invention, an apparatus for crushing a fluid-type filter includes a housing assembly having a base portion, a head portion, and side wall portions joining the base portion to the head portion. A first chamber is defined by the side wall portions, the head portion, and the base portion. A piston is positioned within the first chamber and a power means is adapted to move the piston longitudinally within the first chamber, with the power means being selectively operable by a control means. A first cylindrical sleeve is positioned within the first chamber and encloses the piston. The first sleeve and the piston form a second chamber.

Diminishing landfill space necessitates that material being deposited in the landfill be as compact as possible. It has, therefore, become a requirement that large volume machine service operators crush or compact used fluid-type filters, such as oil filters. Crushing of such filters requires a large mechanical force and, advantageously the crushing force is applied quickly, efficiently, and safely.

The subject crushing apparatus utilizes a high pressure hydraulically operated ram assembly and a specially designed housing and associated piston and cylindrical sleeves to accomplish the filter crushing operation in a quick, efficient, and safe manner. Additionally, a considerable amount of used oil is collected from the filters during the crushing operation.

BEST MODE FOR CARRYING OUT THE INVENTION

Figure 1:
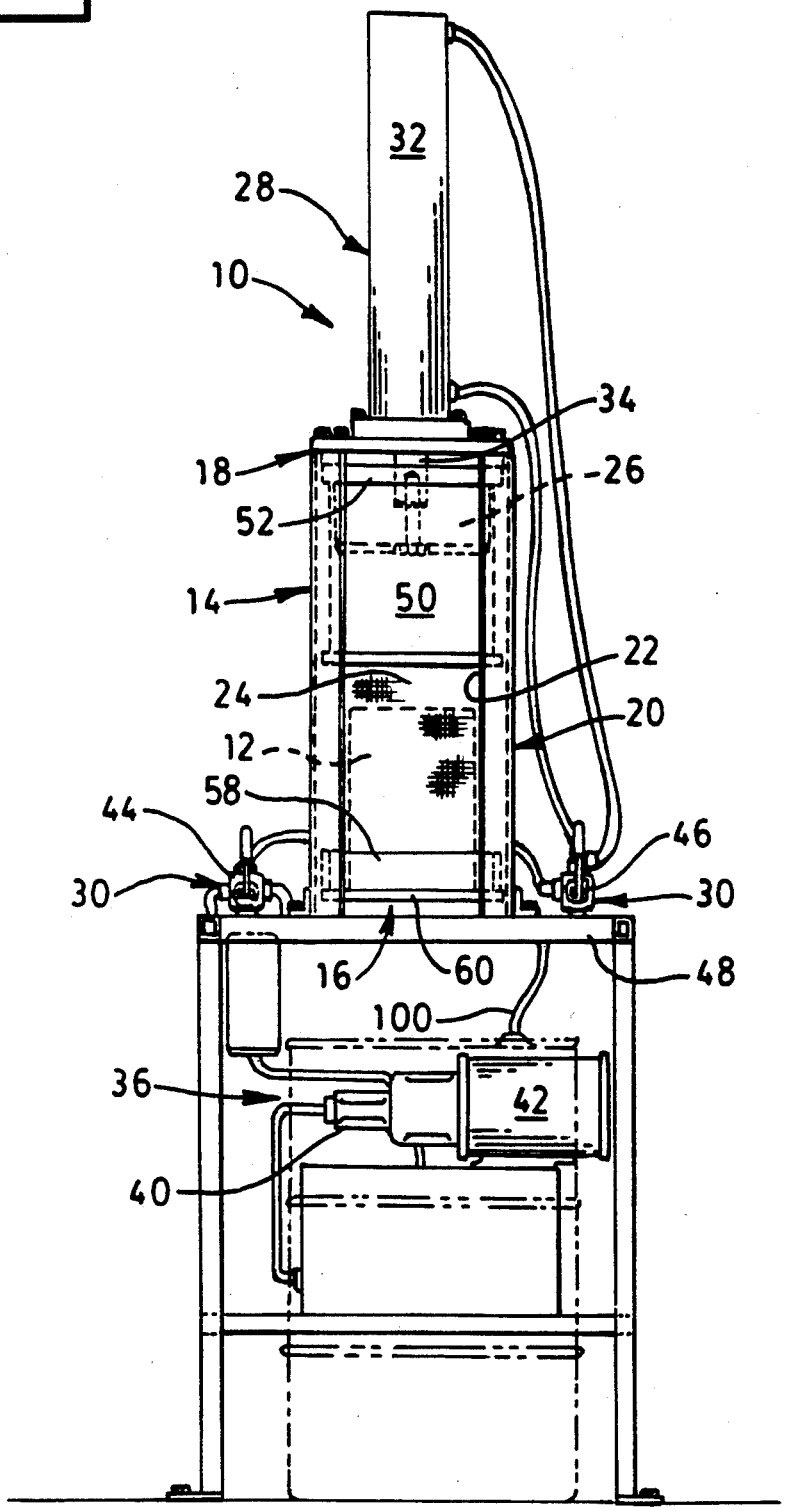
FIG. 1 is a diagrammatic front elevational view of a filter crushing apparatus of the present invention.
Figure 2:
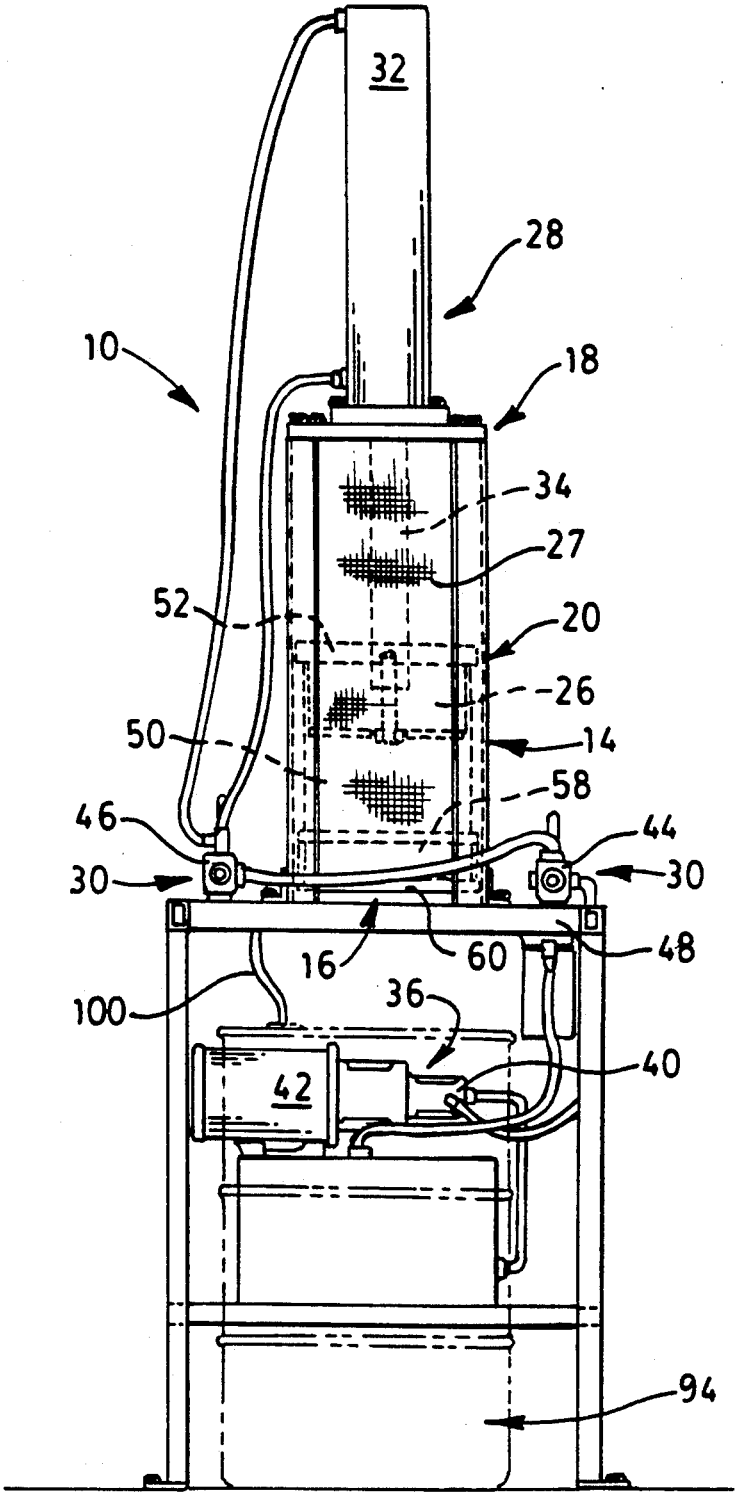
FIG. 2 is a diagrammatic rear elevational view of the apparatus shown in FIG. 1.
Figure 3:
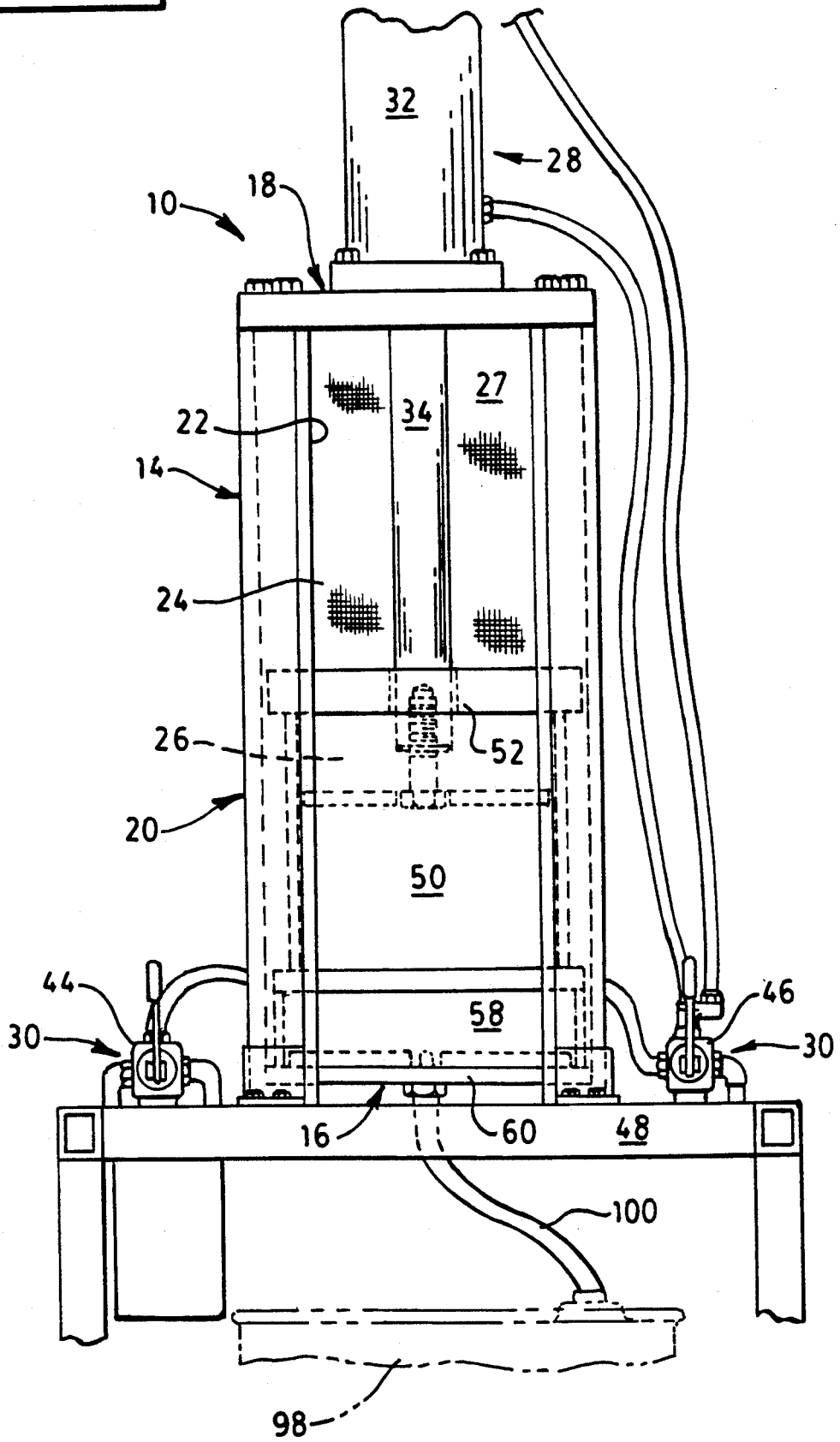
FIG. 3 is a diagrammatic front elevational view, on an enlarged scale, of a portion of the apparatus shown in FIG. 1.

Referring to the drawings, an apparatus 10 for holding and crushing fluid-type filters, such as an oil filter 12, includes a housing assembly 14 having a base portion 16, a head portion 18, and side wall portions 20, which extend between and join the base portion 16 to the head portion 18. The side wall portions 20, the head portion 18, and the base portion 16 are joined together to define a first internal chamber 22. The side wall portions 20 are spaced apart to define first and second openings 24,25 into the first chamber 22. The first opening 24 provides access to the first chamber 22 for inserting a filter 12 to be crushed and for removing a filter 12 after it has been crushed.

The second opening 25 into the first chamber 22 is closed off by a screen 27 of lightweight expanded metal or some similar material. The screen 27 prevents foreign objects from being inserted into the first chamber 22 through the second opening 25.

The apparatus 10 further includes a substantially circular ram plate, or piston 26, positioned within the first chamber 22, power means 28 for moving the piston 26 longitudinally within the first chamber 22, and control means 30 for selectively operating the power means 28. The power means 28 can include any type of force producing mechanism, and in the preferred embodiment includes fluid power means 28 having a hydraulically actuated cylinder assembly 32, including a cylinder rod 34 extending outwardly of the cylinder assembly 32 and connected to the piston 26. In the subject embodiment the power means also includes a source of pressurized fluid 36, including a fluid reservoir 38, a hydraulic pump 40, and a motor 42 for driving the hydraulic pump 40. The control means 30 includes first and second control valves 44,46.

The apparatus 10 also includes a support means, such as a support table 48, which supports the housing assembly 14, the power means 28, and the control means 30. For convenience and compactness, the fluid reservoir 38, the pump 40, the motor 42, and other related components are positioned within the confines of the support table 48 and below the housing assembly 14.

A first cylindrical sleeve 50 is positioned within the first chamber 22 and encloses the piston 26. A circular plate 52 is secured to the first sleeve 50, as by welding, and rests on the upper surface 54 of the piston 26. The first sleeve 50 and the piston 26 define a second chamber 56. A second cylindrical sleeve 58 is also positioned within the first chamber 22 and is connected to the base portion 16. Preferably, the base portion 16 includes a base plate 60, having a supporting surface 62, and the second sleeve 58 is joined to supporting surface 62, as by welding. The second sleeve 58 and the base plate 60 define a third chamber 64. During a filter crushing operation, the second and third chambers 56,64 are adapted to substantially completely enclose the filter 12.

Figure 4:
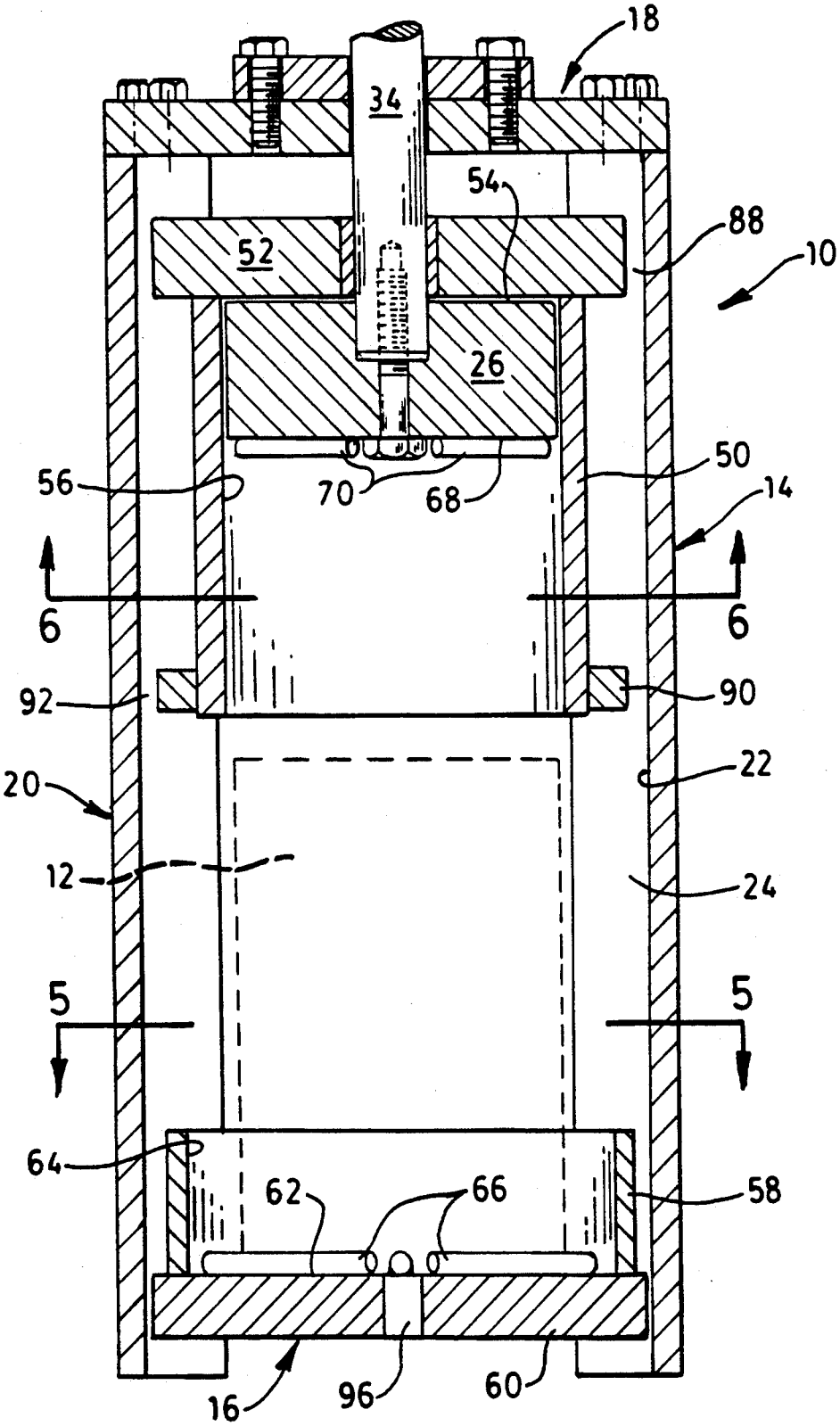
FIG. 4 is a diagrammatic sectional view of the subject invention taken generally longitudinally through the apparatus shown in FIG. 3.
Figure 5:
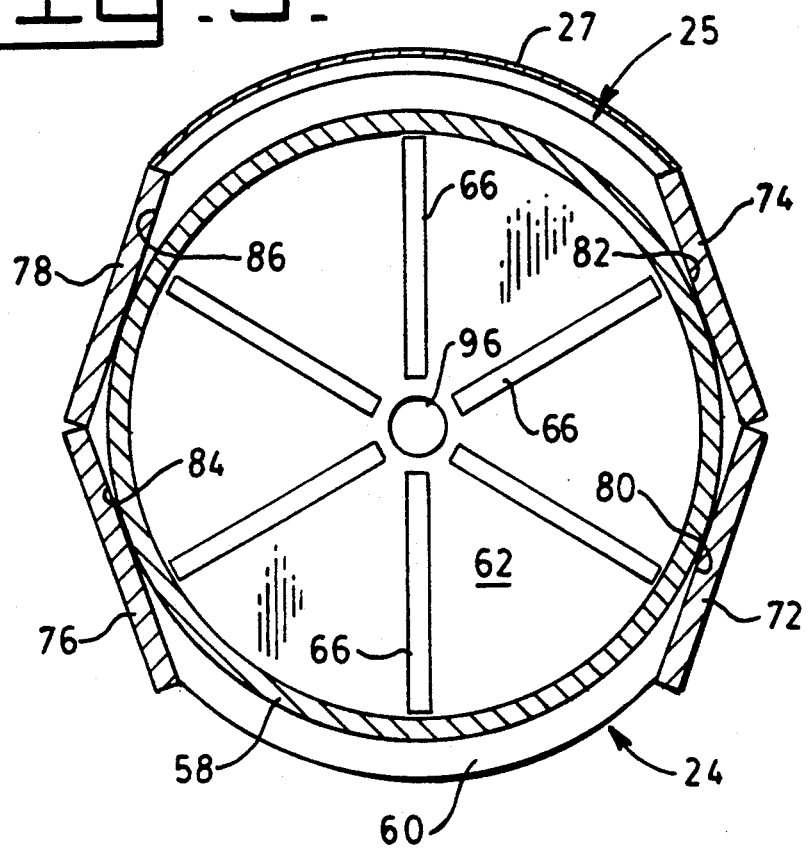
FIG. 5 is a diagrammatic cross-sectional view taken generally along the lines 5—5 of FIG. 4.
Figure 6:
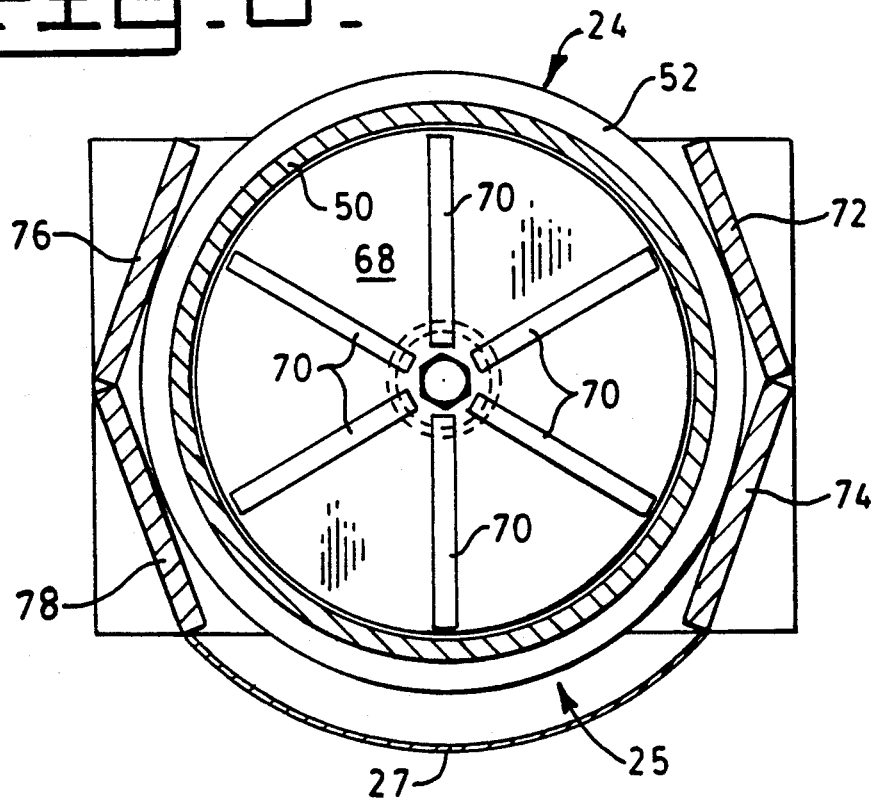
FIG. 6 is a diagrammatic cross-sectional view taken generally along the lines 6—6 of FIG. 4.

With particular reference to FIGS. 4, 5, and 6, the supporting surface 62 of the base plate 60 has a plurality of elongated first ribs 66 secured thereto and extending outwardly therefrom. The piston 26 has a contact surface 68 and a plurality of elongated second ribs 70 are secured to the surface 68 and extend outwardly therefrom. The first and second ribs 66,70 are positioned respectively on the the supporting surface 62 and the contact surface 68 in a star-burst pattern, as viewed in FIGS. 5 and 6. The ribs are adapted to grip the outer end surfaces of a filter 12 during a crushing operation.

With further reference to FIGS. 4, 5, and 6, the wall portions 20 include a plurality of plate members 72,74,76,78. The base plate 60 has flat portions 80,82,84,86 formed on the outer circumferential surface and the plate members 72,74,76,78 are adapted to mate respectively with flat portions 80,82,84,86. Each of the plate members 72,74,76,78 are joined at one end to the base plate 60 and at the opposite end to the head portion 18. The plate members 72,74,76,78 are positioned to provide a first controlled clearance 88 between them and the circular plate 52 as the piston 26 is moved downwardly against a filter 12. A ring member 90 is secured to the outer circumferential wall 92 of the first sleeve 50 and provides a second controlled clearance 92 between the ring 90 and the plate members 72,74,76,78. The first and second controlled clearances 88,92 are substantially similar and provide a means for controlling lateral movement of the piston 26 as the power means 28 moves the piston 26 longitudinally within the first chamber 22.

As the filter 12 is being crushed in the apparatus 10, fluid that has been trapped in the filter is expelled. This fluid is collected by a collecting means 94, which includes a through opening 96 defined by the base plate 60, and a collecting container 98 positioned beneath the base portion 16. Preferably, a flexible tube 100 connects the opening 96 with the container 98.

Figure 7:
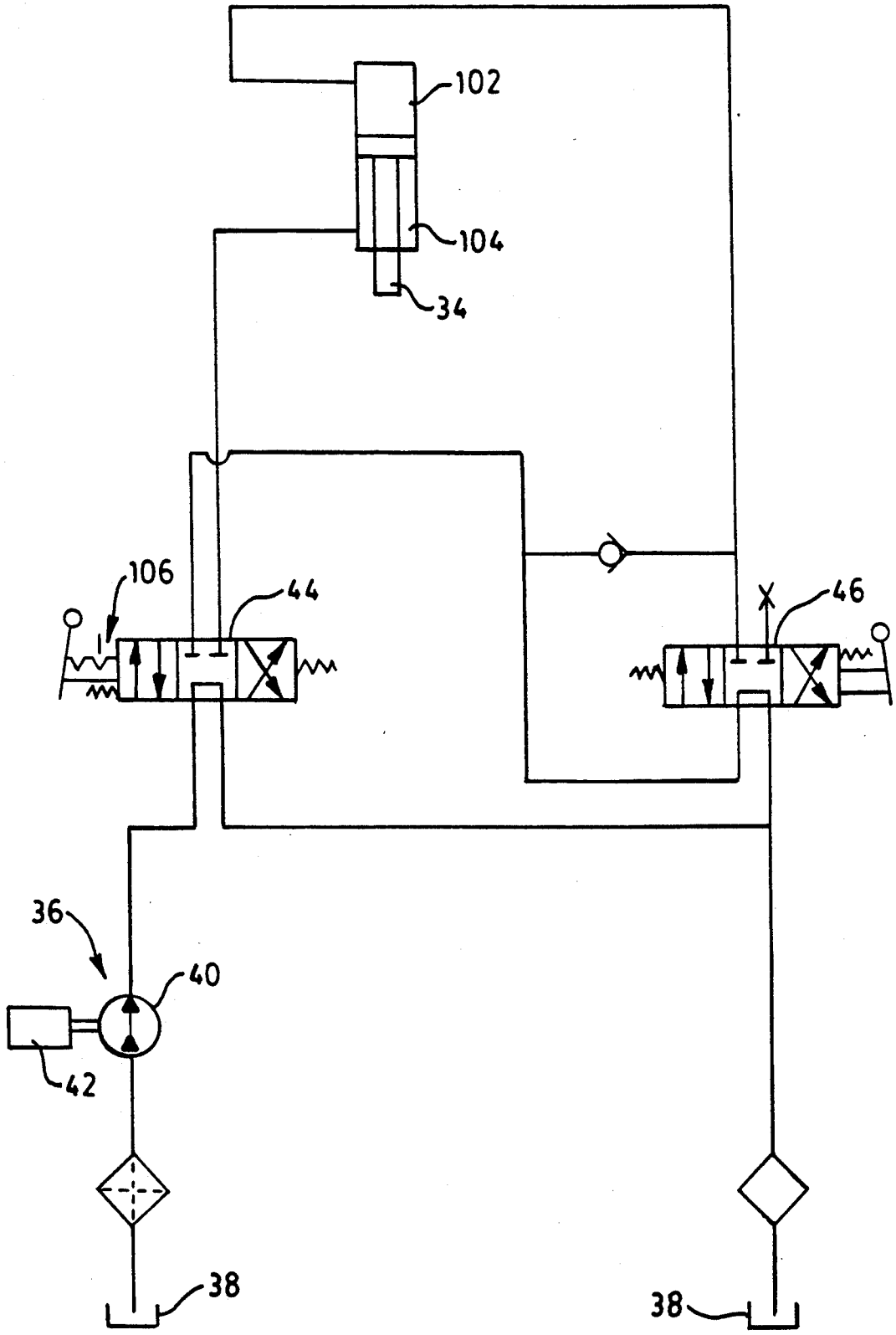
FIG. 7 is a schematic view of a hydraulic circuit used to operate the subject invention.

With particular reference to FIG. 7, the first control valve 44 of the control means 30 is fluidly connected to the source of pressurized fluid 36, such as the pump 40, and to the second control valve 46. The second control valve 46 is in fluid communication with the first control valve 44 and the hydraulic cylinder assembly 32. This arrangement requires that both first and second valves 44,46 be actuated before pressurized fluid is communicated to the head end 102 of the hydraulic cylinder assembly 32, thereby moving the piston 26 downwardly in the first chamber 22 and toward the filter 12. However, pressurized fluid can be communicated to the rod end 104 of the cylinder assembly 32 by actuating the first control valve 44 only, thereby moving the piston 26 upwardly in the first chamber 22 and away from the crushed filter 12. Both of the control valves 44,46 are spring loaded to the center, neutral, position. This requires that both valves 44,46 be manually held in the activated position to send pressurized fluid to the head end 102 of the cylinder assembly 32 and move the piston 26 downwardly. However, the first control valve 44 has a detent position 106 which holds the valve 44 open while pressurized fluid is communicated to the rod end 104 of the cylinder assembly 32. Once the cylinder rod 34 has moved substantially entirely into the cylinder assembly 32, a build-up of pressure shifts the control valve 44 out of the detent position 106 and into the center, neutral position. With the control valve 44 in the detent position 106, the operator can remove the crushed filter 12 from the apparatus 10 and place another filter 12 within the apparatus 10 for the next crushing cycle, thereby decreasing the total cycle time.

INDUSTRIAL APPLICABILITY

With reference to the drawings, the subject apparatus 10 is particularly suited for reducing the overall longitudinal dimensions of used fluid-type filters by a crushing operation. At the start of a crushing cycle, a used filter 12 is inserted into the first chamber 22 and positioned into the third chamber 64 and placed upon the base plate 60. The operator of the apparatus 10 then shifts the first and second control valves 44,46 to a first activated position. Pressurized oil is now communicated from the source 36 to the head end 102 of the hydraulic cylinder assembly 32 through the first and second control valves 44,46. The pressurized fluid forces the piston 26 downwardly within the first chamber 22 and into contact with the filter 12. As the piston 26 moves downwardly, the first sleeve 50, which is supported by the piston 26, also moves downwardly. Depending upon the overall size of the filter 12, the circular plate 52 comes to rest on the top surface of the second sleeve 58 just prior to, or shortly after, contact between the piston 26 and the filter 12. This ensures that the filter 12 is completely enclosed within the second and third chambers 56,64, during the crushing operation.

Continued downward movement of the piston 26 completes the filter crushing operation. During this operation, used fluid is expelled from the filter 12 and flows into opening 96 in the base plate 60. The oil then flows through a flexible tube 100 and into the collecting container 98.

At the completion of the crushing cycle, the operator releases the second control valve 46 and it returns to its spring centered, neutral position. The operator then shifts the first control valve 44 to its detent position and pressurized fluid is communicated to the rod end 104, which raises the cylinder rod 34 and the piston 26. As the piston 26 moves upwardly in the first chamber 22, the operator reaches into the first chamber 22 and removes the crushed filter 12 and deposits it into a waste disposed container. An uncrushed filter 12 is then placed into the apparatus 10 and the crushing cycle is repeated. Each cycle is completed in a matter of seconds.

Other aspects, objects, and advantages of this invention can be obtained from a study of the drawings, the disclosure, and the appended claims.

I claim:

1. Apparatus for crushing a fluid-type filter comprising:

a housing assembly having a base portion, a head portion, and side wall portions joining said base portion to said head portion, said side wall portions, said head portion, and said base portion defining a first chamber, and said side wall portions further defining an opening into said first chamber;

a piston positioned within said first chamber;

a power means for moving said piston longitudinally within said first chamber, including a rod member connecting said power means to said piston;

control means for selectively operating said power means;

means for supporting said housing assembly, said power means and said control means; and a first cylindrical sleeve positioned within said first chamber, said first sleeve enclosing said piston and being adapted to move with said piston, said first sleeve and said piston defining a second chamber; and means for controlling lateral movement of said piston as said power means moves said piston longitudinally within said first chamber, including a circular plate secured to a first end portion of said cylindrical sleeve and a ring member secured to a second end portion of said cylindrical sleeve, said circular plate and said ring member extending radially outwardly from said first cylindrical sleeve, said circular plate and said ring member cooperating with said side wall portions for controlling said lateral movement.

2. An apparatus, as set forth in claim 1, including a second cylindrical sleeve positioned within said first chamber and in contact with said base portion, said second sleeve and said base portion defining a third chamber.

3. An apparatus, as set forth in claim 1, wherein said base portion includes a base plate having a supporting surface, and including a plurality of first elongated ribs secured to and extending outwardly from said supporting surface.

4. An apparatus, as set forth in claim 1, wherein said piston has a contact surface, and including a plurality of elongated second ribs secured to and extending outwardly from said contact surface.

5. An apparatus, as set forth in claim 3, including means for collecting fluid expelled from said crushed filters, said means for collecting including a through opening defined by said base plate.

6. An apparatus, set forth in claim 1, wherein said power means includes a source of pressurized fluid and said control means includes first and second control valves, said first valve being fluidly connected to said source of pressurized fluid and to said second control valve, and said second control valve being in fluid communication with first control valve and said power means.

7. An apparatus, as set forth in claim 1, wherein said power means includes an hydraulically powered cylinder assembly, including a cylinder rod connected to said piston.

8. Apparatus for supporting and holding a fluid-type filter and for crushing said filter as it is supported and held in said apparatus, comprising:

a housing assembly having a base portion including a base plate, a head portion, and a wall portion extending between and joining said base portion and said head portion, said wall portion, said base portion, and said head portion defining a first chamber, said wall portion further defining an opening into said first chamber;

a substantially circular ram plate positioned within said first chamber, said ram plate having a contact surface including a plurality of elongated ribs extending outwardly from said contact surface;

fluid power means for moving said ram plate within said first chamber, said power means including a fluid actuated cylinder and a rod extending outwardly of said cylinder and connected to said ram plate;

a first cylindrical sleeve positioned within said first chamber and being adapted to move with said ram plate, said first sleeve surrounding said ram plate, said first sleeve and said ram plate defining a second chamber;

a second cylindrical sleeve positioned within said first chamber and connected to said base plate, said second sleeve and said base plate defining a third chamber, said second and third chambers being adapted to substantially completely enclose said filter during said crushing operation; and means for controlling lateral movement of said ram plate as said fluid power means moves aid ram plate longitudinally within said first chamber, including a circular plate secured to a first end portion of said first cylindrical sleeve and a ring member secured to a second end portion of said first cylindrical sleeve, said circular plate and said ring member extending radially outwardly from said first cylindrical sleeve, said circular plate and said ring member cooperating with said wall portion for controlling said lateral movement.

* * * * *